US010567860B2

(12) United States Patent
Han

(10) Patent No.: US 10,567,860 B2
(45) Date of Patent: Feb. 18, 2020

(54) OPEN-CLOSE TYPE EARPHONE STRUCTURE

(71) Applicant: Tai-Sheng Han, New Taipei (TW)

(72) Inventor: Tai-Sheng Han, New Taipei (TW)

(73) Assignee: EVGA CORPORATION, New Taipei (TW)

( * ) Notice: Subject to any disclaimer, the term of this patent is extended or adjusted under 35 U.S.C. 154(b) by 0 days.

(21) Appl. No.: 15/991,928

(22) Filed: May 29, 2018

(65) Prior Publication Data

US 2019/0373351 A1 Dec. 5, 2019

(51) Int. Cl.
*H04R 5/033* (2006.01)
*H04R 1/10* (2006.01)

(52) U.S. Cl.
CPC ..... *H04R 1/1008* (2013.01); *H04R 1/1066* (2013.01); *H04R 1/1075* (2013.01)

(58) Field of Classification Search
CPC ..... H04R 1/1008
USPC ..... 381/371, 373
See application file for complete search history.

(56) References Cited

U.S. PATENT DOCUMENTS 4,041,256 A * 8/1977 Ohta ..... H04R 1/1058 381/371
4,993,074 A * 2/1991 Carroll ..... H04R 5/033 181/129
6,259,796 B1 * 7/2001 Lin ..... H04R 1/1008 381/371
7,761,932 B2 * 7/2010 Faussett ..... A61F 11/14 2/209
8,965,029 B2 * 2/2015 Mizuno ..... H04R 1/1091 381/371
9,445,182 B2 * 9/2016 Pizzaro ..... H04R 1/1058
10,129,631 B2 * 11/2018 Jetter ..... H04R 1/08
10,149,033 B2 * 12/2018 Karacal ..... H04R 1/1008
10,154,335 B1 * 12/2018 Hoang ..... H04R 1/1075
10,187,715 B2 * 1/2019 Karacal ..... H04R 1/1008
2006/0104471 A1 * 5/2006 Tsunoda ..... H04R 1/1041 381/374
2012/0207320 A1 * 8/2012 Avital ..... H04R 1/1041 381/74
2015/0125023 A1 * 5/2015 Blonder ..... H04R 1/1066 381/373

* cited by examiner

*Primary Examiner* — Curtis A Kuntz
*Assistant Examiner* — Ryan Robinson
(74) *Attorney, Agent, or Firm* — Chen-Yang Chen; Law Offices of Scott Warmuth

(57) ABSTRACT

An open-close type earphone structure, comprising a headwear rack, a pair of ear cover sets and a positioning module. The pair of ear cover sets are respectively disposed on two opposite ends of the headwear rack, and each of the ear cover sets includes a first earphone body, a second earphone body and an external frame; the first and the second earphone bodies are opposingly connected and assembled and are correspondingly disposed to the headwear rack; a shell correspondingly covers the external frame, and the shell and the external frame collectively define an accommodation space for accommodating a speaker unit. The positioning module is correspondingly disposed to the ear cover sets, and the positioning module has at least one connection unit and at least one positioning unit, so as to enable the shell and the external frame to be opened and closed with respect to the first earphone body.

17 Claims, 10 Drawing Sheets

OPEN-CLOSE TYPE EARPHONE STRUCTURE

FIELD OF THE INVENTION

The present invention relates to an open-close type earphone structure, and more particularly to an open-close type earphone structure enabling an external environmental sound to be heard while listening to music.

BACKGROUND OF THE INVENTION

With the advances of technology, the electronic products are developed in response to the trend of lightness and miniaturization, so as to allow people to be able to use miniaturized electronic products anywhere and at any time. As a type of audio output device, earphones are widely used in the daily lives of people, and have become a necessary device to accompany various types of audio output equipment (for electronic equipment such as CD, MP3, MP4 or computers). The current earphones mainly include two modes; the headwear type earphone and the in-ear type earphone, and the headwear earphone has become widely popular with many consumers due to advantages such as being comfortable to wear and has good audio quality.

Currently, the headwear earphones sold on the market include ear covers on the left and on the right, which are used to provide for the function of sound playback when it is worn on the head of a user; however, this singular function can no longer satisfy the requirements of the consumers.

SUMMARY OF THE INVENTION

Accordingly, to solve the above-mentioned problem effectively, a primary objective of the present invention is to provide an open-close type earphone structure capable of enabling an external environmental sound to be heard while listening to music.

A secondary objective of the present invention is to provide an open-close type earphone structure having multiple applications.

Another secondary objective of the present invention is to provide an open-close type earphone structure having significantly increased convenience in use.

A further secondary objective of the present invention is to provide an open-close type earphone structure having an adjustable angle during opening and closing.

A further secondary objective of the present invention is to provide an open-close type earphone structure having a best listening angle.

To achieve the above objectives, the present invention provides an open-close type earphone structure comprising a headwear rack, a pair of ear cover sets and a positioning module; the pair of ear cover sets are respectively disposed on two opposite ends of the headwear rack, and each of the ear cover sets includes a first earphone body, a second earphone body and an external frame; the first earphone body has a first side and a second side, and the second side is correspondingly disposed to the headwear rack; the second earphone body has a third side and a fourth side, and the third side is correspondingly disposed to the headwear rack and is opposingly connected to and assembled with the second side; the fourth side has an ear cover provided thereon. The external frame has a first surface and a second surface, and the second surface is correspondingly provided on the first side; a shell correspondingly covers the first surface, and the shell and the first surface collectively define an accommodation space therebetween for accommodating a speaker unit. The positioning module is correspondingly disposed to the ear cover sets, and the positioning module has at least one connection unit and at least one positioning unit, so as to enable the shell and the external frame to be opened and closed with respect to the first earphone body via the connection unit and the positioning unit.

By utilizing the structure of the present invention, when a user wears the open-close type earphone structure and listens to music, the user is unable to hear sounds from the surrounding environment under a normal-use condition; if the user desires to hear the external sounds, the user can pull open the shell by using the positioning module disposed on the ear cover sets without completely separating the first earphone body. Consequently, without having to completely take off the earphone, the user is able to hear the external sounds while listening to music, thus achieving an open-close type earphone structure having multiple applications, and significantly increasing the convenience in use.

DETAILED DESCRIPTION OF THE PREFERRED EMBODIMENTS

Figure 1:
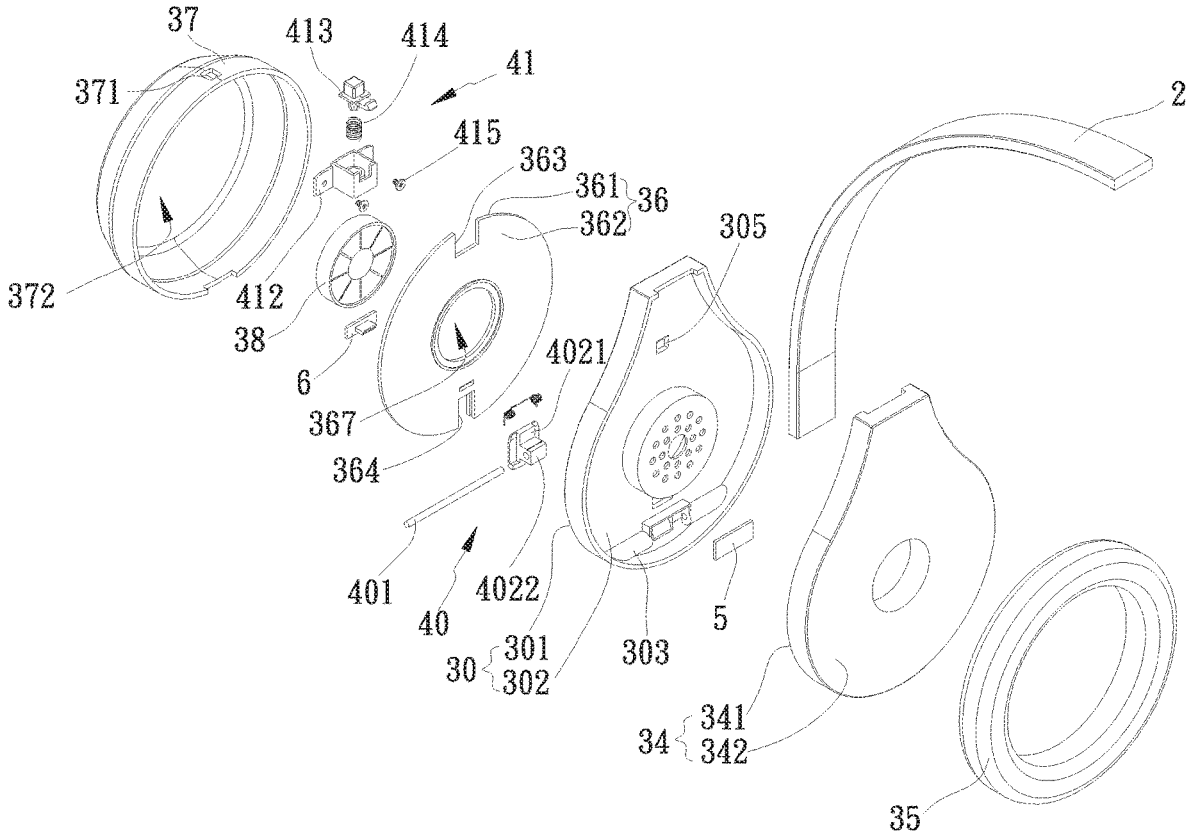
FIG. 1 is a stereoscopic disassembled view in accordance with a first embodiment of the open-close type earphone structure of the present invention.

To enable a further understanding of said objectives and the structural and functional characteristics of the present invention, the preferred embodiments provided in the drawings are used for the purpose of elucidation.

Figure 2:
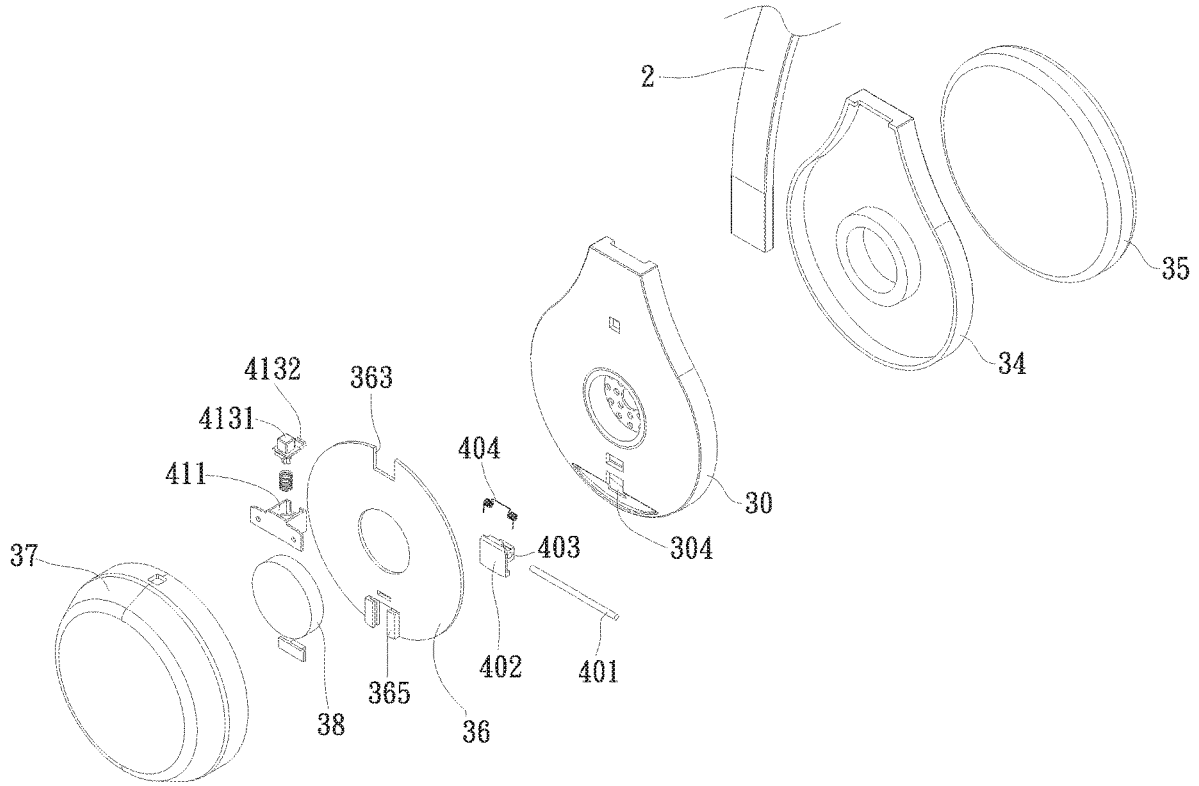
FIG. 2 is a stereoscopic disassembled view showing another perspective of the first embodiment of the open-close type earphone structure of the present invention.
Figure 3:
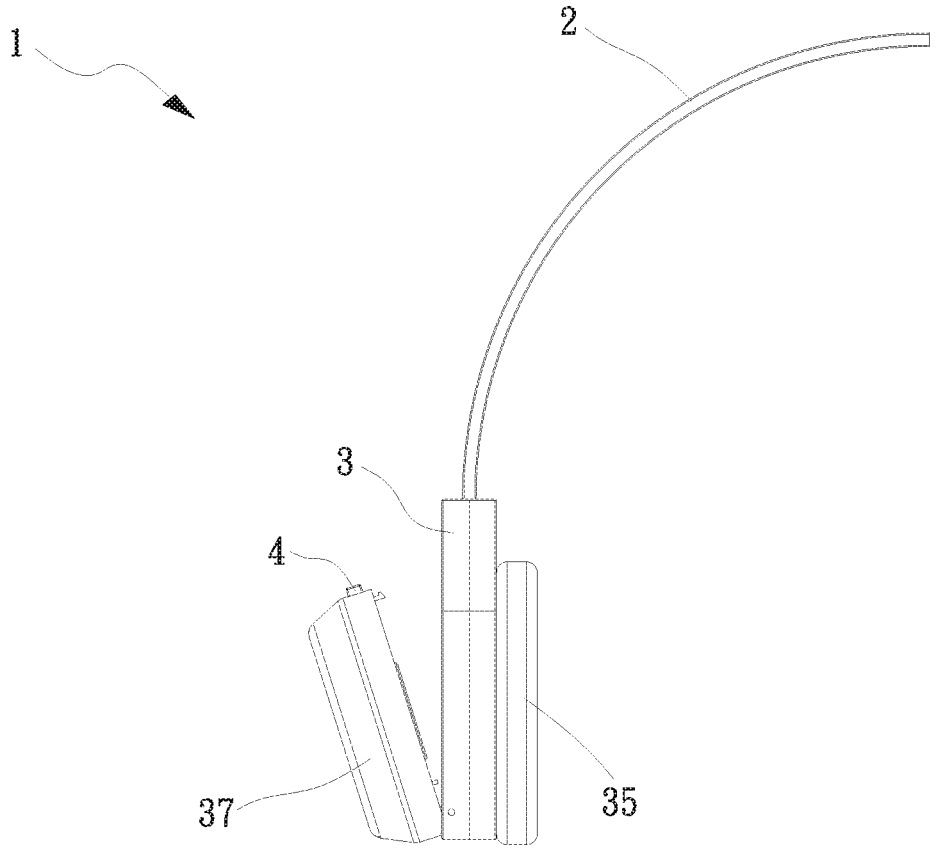
FIG. 3 is a stereoscopic assembled view in accordance with the first embodiment of the open-close type earphone structure of the present invention.

FIGS. 1, 2 and 3 illustrate the stereoscopic disassembled views and the stereoscopic assembled view of the open-close type earphone structure of the present invention. As indicated in the drawings, an open-close type earphone structure 1 comprises a headwear rack 2, a pair of ear cover sets 3 and a positioning module 4; the ear cover sets 3 are respectively disposed on two opposite ends of the headwear rack 2, and the positioning module 4 is correspondingly disposed to the ear cover sets 3 and has at least one connection unit 40 and at least one positioning unit 41, so as to enable a shell 37 and an external frame 36 to be opened and closed with respect to a first earphone body 30 via the connection unit 40 and the positioning unit 41.

Each of the previously described ear cover sets 3 comprises a first earphone body 30, a second earphone body 34 and an external frame 36; the first earphone body 30 has a first side 301 and a second side 302, and the second side 302 is correspondingly disposed to the headwear rack 2; the second earphone body 34 has a third side 341 and a fourth side 342, and the third side 341 is correspondingly disposed to the headwear rack 2 and is opposingly connected to and assembled with the second side 302; the fourth side 342 has an ear cover 35 provided thereon, so as to enable a user to press the ear against the ear cover 35 while using the open-close type earphone structure 1; the external frame 36 has a first surface 361, a second surface 362 and a hole 367, in which the second surface 362 is correspondingly provided on the first side 301 of the first earphone body 30; the shell 37 correspondingly covers the first surface 361, and the shell 37 and the first surface 361 of the external frame 36 collectively define an accommodation space 372 therebetween; a speaker unit 38 is accommodated in the accommodation space 372 and correspondingly and embeddingly provided in the hole 367, and the speaker unit 38 is used for audio output.

In addition, the open-close type earphone structure 1 further has at least one first electronic component 5 correspondingly and embeddingly provided on the second side 302 of the first earphone body 30, and a second electronic component 6 correspondingly and embeddingly provided on the first surface 361 of the external frame 36.

It should be noted that in the present invention, the external frame 36 is fixed on a peripheral edge of the shell 37 by adhering or gluing together the shell 37 and the external frame 36; that is, when the shell 37 and the external frame 36 are opened or closed with respect to the first earphone body 30, the shell 37 drives the external frame 36 to be separated from the first earphone body 30 together.

The details about how the connection unit 40 and the positioning unit 41 form a structure capable of being opened and closed with respect to the first earphone body 30 are further explained as follows:

In this embodiment, the connection unit 40 further includes a fixing shaft 401, a pivotal member 402 and a torsion spring 404; the fixing shaft 401 is correspondingly and penetratingly provided through the pivotal member 402 and the torsion spring 404, wherein the pivotal member 402 further has an engagement end 4021 and a pivotal end 4022 formed thereon, and the engagement end 4021 is correspondingly and engagingly provided on the external frame 36; the pivotal end 4022 has a pivot hole 403 formed thereon for the fixing shaft 401 to be penetratingly provided; the first earphone body 30 described above further has a fixing portion 303 and an accommodation portion 304 formed thereon; two ends of the fixing shaft 401 are correspondingly inserted into the fixing portion 303; the pivotal member 402 is correspondingly accommodated in the accommodation portion 304.

The positioning unit 41 further includes a positioning member 411, a button 413 and a springy member 414, in which the positioning member 411 has two sides thereof respectively protruded and extended to form a positioning portion 412, and at least one fastening member 415 is provided on the positioning portion 412 for enabling corresponding fastening, so as to fix the positioning unit 41 on the shell 37; the button 413 and the springy member 414 are correspondingly disposed in the positioning member 411, and the button 413 further has a press portion 4131 and a snap-on portion 4132 formed thereon; a via hole 371 is openly disposed on the shell 37 to expose the press portion 4131 from the via hole 371; the first earphone body 30 has an opening 305 for enabling the snap-on portion 4132 to be snapped onto the opening 305; the external frame 36 described above is further openly provided with a first notch 363 and a second notch 364, and the positioning member 411 is correspondingly and embeddingly provided in the first notch 363; a socket 365 is further formed on the first surface 361 of the external frame 36 corresponding to the second notch 364, and the engagement end 4021 of the pivotal member 402 is correspondingly inserted into the socket 365.

Figure 4:
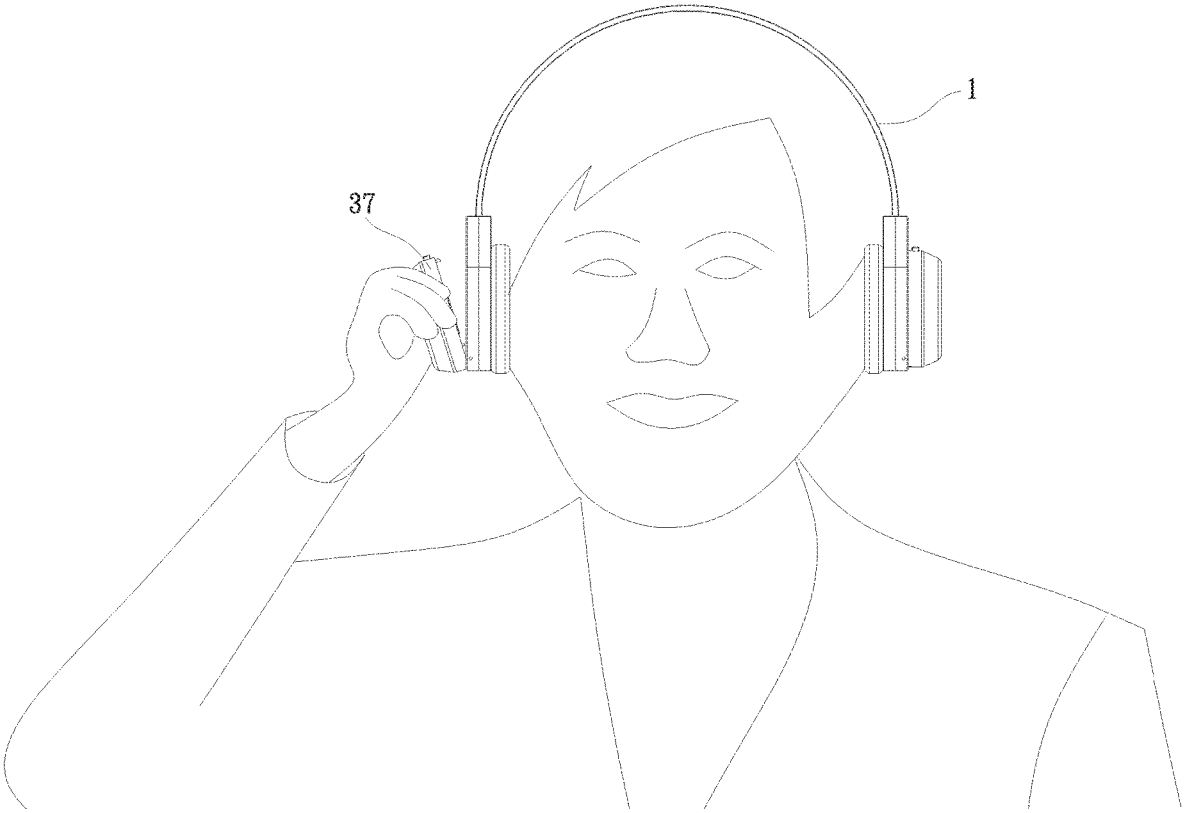
FIG. 4 is an implemented schematic view in accordance with the first embodiment of the open-close type earphone structure of the present invention.

Referring to FIG. 4, which is an implemented schematic view in accordance with the first embodiment of the present invention. By using the designed structure of the present invention, when the user wears the open-close type earphone structure 1 and listens to music, the user is unable to hear sounds from the surrounding environment under a normal-use condition; if the user desires to hear the external sounds, the user can firstly press the press portion 4131 of the button 413 on the shell 37, which drives the snap-on portion 4132 engaged on the first earphone body 30 to be disengaged so as to enable the shell 37 and the external frame 36 to be separated from the first earphone body 30, and the engagement end 4021 of the pivotal member 402 still engaged on the external frame 36 and a structure resulted from the pivotal end 4022 being correspondingly and pivotally provided on the first earphone body 30 enable the shell 37 and the external frame 36 to still be partially connected to the first earphone body 30. That is, the connection unit 40 and the positioning unit 41 disposed on the ear cover sets 3 enable the shell 37 to be pulled open without becoming completely separated from the first earphone body 30. As a result, the external sounds can still be heard while listening to music without having to completely taking off the earphone, thereby achieving an open-close type earphone structure 1 having multiple applications, and significantly increasing the convenience in use.

Further, it should be noted that the connection unit 40 of the open-close type earphone structure 1 further has an adjustment portion (not shown in the drawings), and the adjustment portion can be an additional singular component that is mutually disposed with the connection unit 40, or directly formed on the connection unit 40; the adjustment portion is able to generate a friction force when pressed tightly against the connection unit 40, so as to enable an angle between the connection unit 40 and the first earphone body 30 to be adjusted in a stepwise manner when the connection unit 40 and the first earphone body 30 are opened and closed with respect to each other; by using the adjustment portion to form different angles therebetween, different sound fields and sound volumes can be generated, and thus the user can use the adjustment portion to obtain a best listening angle between music playing in the earphone and external environmental sounds according to personal preferences and use requirements.

Figure 5:
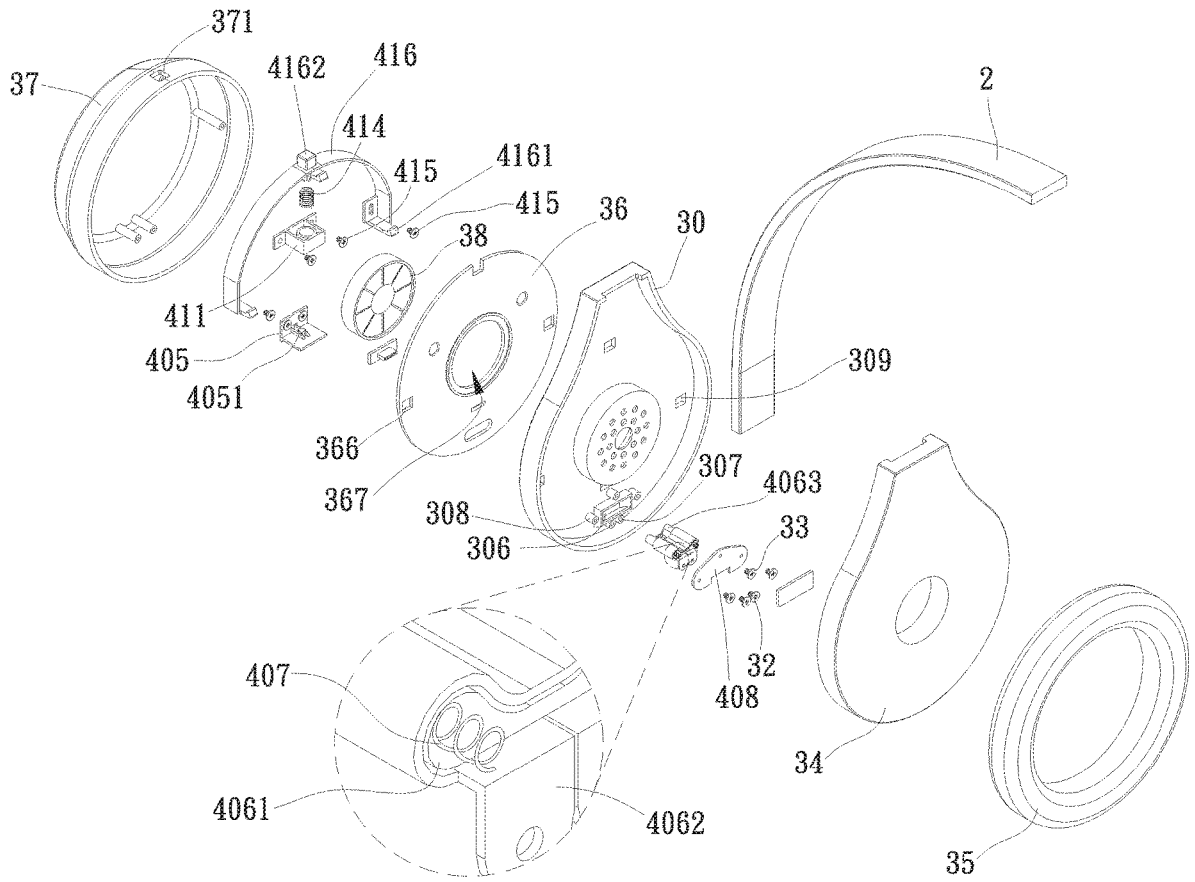
FIG. 5 is a stereoscopic disassembled view in accordance with a second embodiment of the open-close type earphone structure of the present invention.
Figure 6:
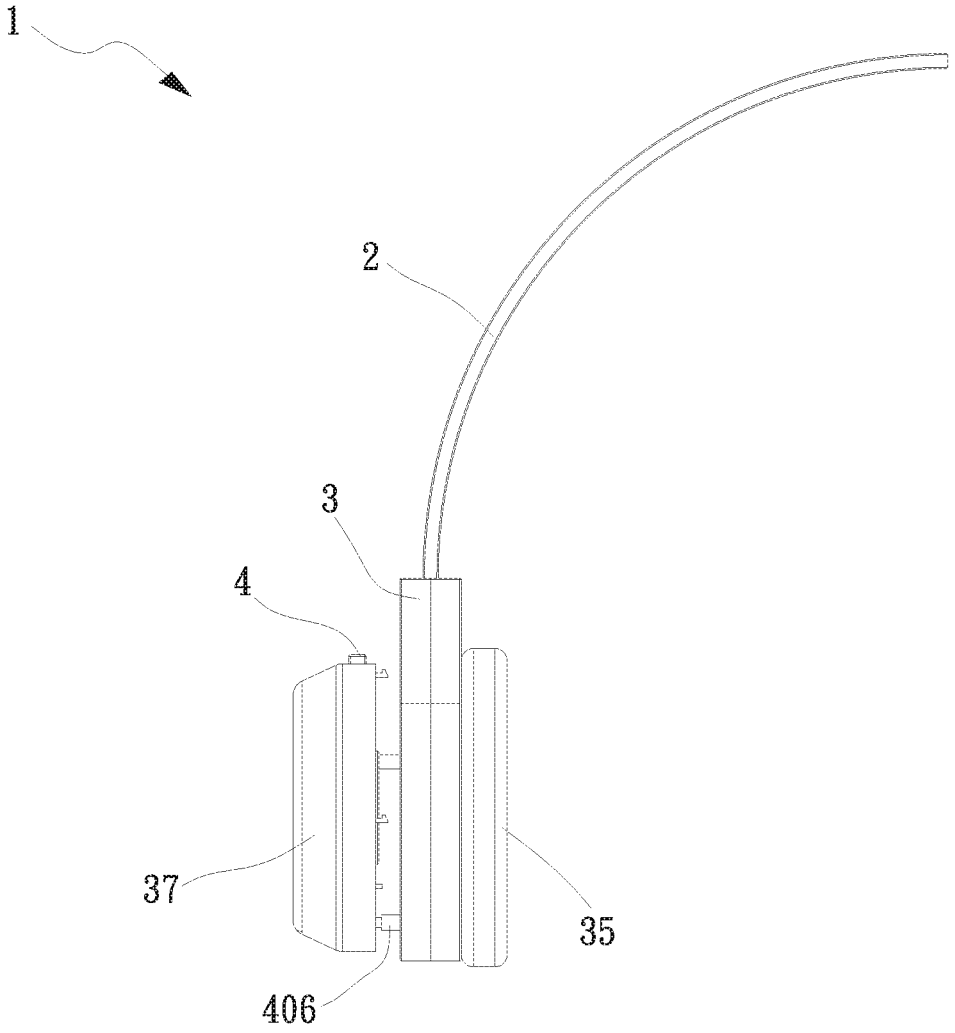
FIG. 6 is a stereoscopic assembled view in accordance with the second embodiment of the open-close type earphone structure of the present invention.
Figure 7:
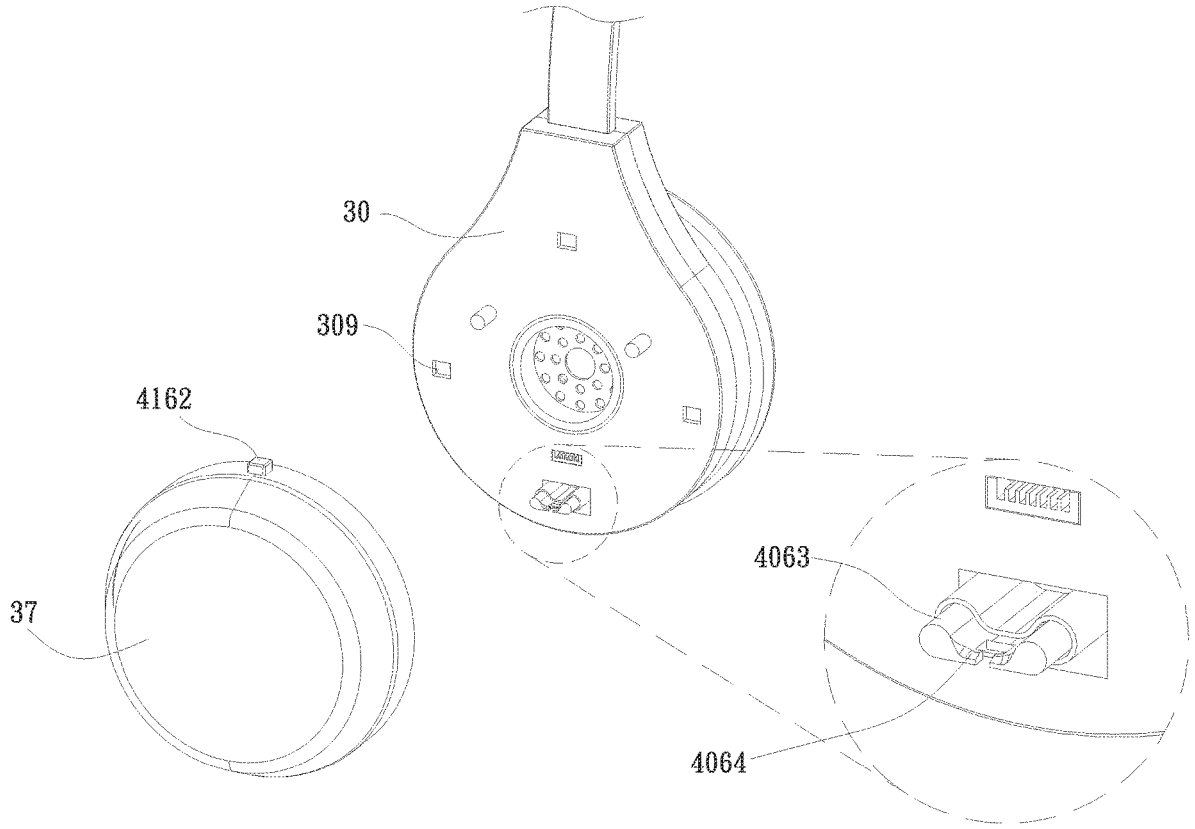
FIG. 7 is a stereoscopic enlarged view in accordance with the second embodiment of the open-close type earphone structure of the present invention.
Figure 8:
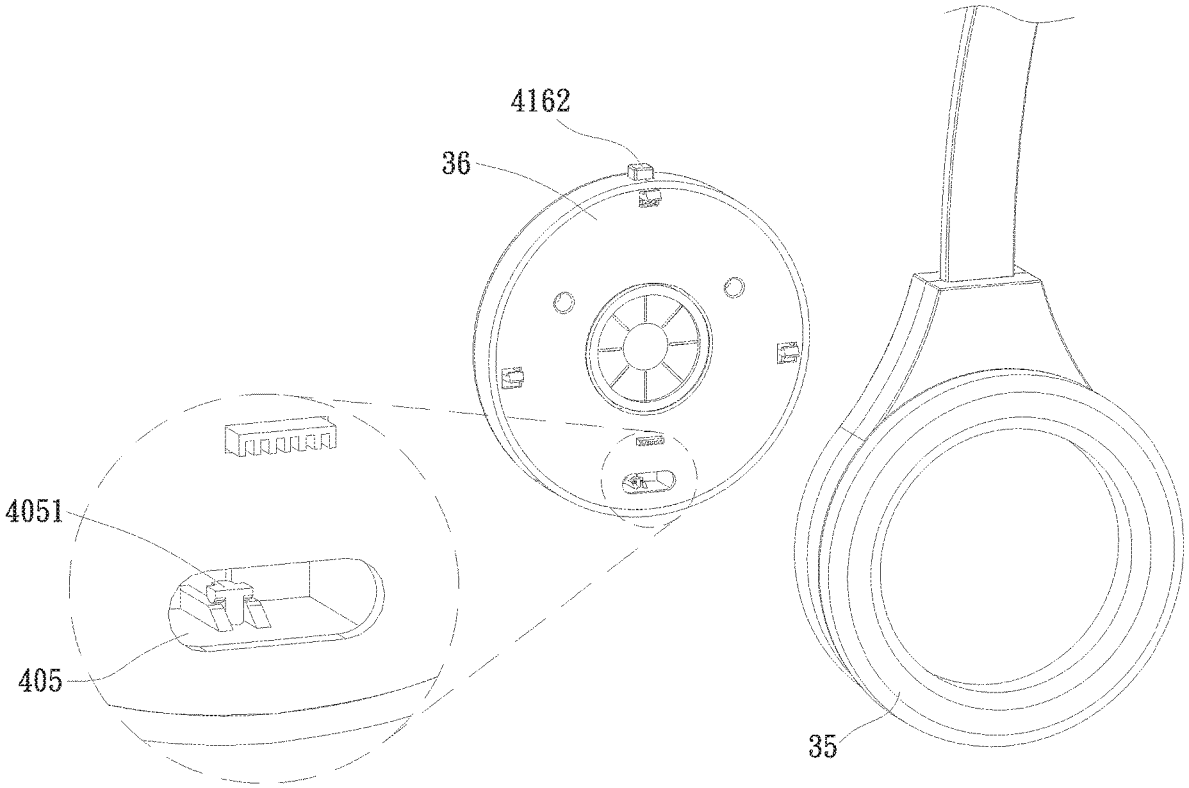
FIG. 8 is another stereoscopic enlarged view in accordance with the second embodiment of the open-close type earphone structure of the present invention.

In addition to FIG. 1, referring to FIGS. 5 and 6, which are the stereoscopic disassembled view and the stereoscopic assembled view in accordance with a second embodiment of the open-close type earphone structure of the present invention. The corresponding relationship between a part of components of the open-close type earphone structure is identical to that of the open-close type earphone structure described above, and thus will not be repeated here. The main difference between the open-close type earphone structure and the one described above is that the connection unit 40 further comprises an engagement member 405 and a sliding member 406, wherein the engagement member 405 is correspondingly disposed on an inner side of the shell 37, and the sliding member 406 is correspondingly and penetratingly disposed through the first earphone body 30 and engaged on the engagement member 405; the sliding member 406 further has an abutting end 4061, a sliding end 4063 and an extension portion 4062 formed thereon; an elastic member 407 is provided on the abutting end 4061 and correspondingly abutted against a fixing plate 408; at least a gap 4064 is formed on a front end of the sliding end 4063 and correspondingly engaged with a protrusion bar 4051 of the engagement member 405 (as shown in FIGS. 7 and 8); the extension portion 4062 is formed by having the abutting end 4061 protruded and extended downwards; the first earphone body 30 described above further has a through hole 306, at least one first locking hole 307 and at least one second locking hole 308 formed thereon, in which the sliding end 4063 is correspondingly and penetratingly disposed through the through hole 36, and at least one first locking attachment 32 is correspondingly and penetratingly disposed through the extension portion 4062 of the sliding member 406 and fastened on the first locking hole 307, while at least one second locking attachment 33 is correspondingly and penetratingly disposed through the fixing plate 408 and fastened on the second locking hole 308.

The positioning unit 41 further comprises a positioning rack 416, a positioning member 411 and a springy member 414, in which the positioning rack 416 has a key 4162 protrudingly provided thereon, and the positioning rack 416 is correspondingly disposed on an inner wall of the shell 37; an outer peripheral edge of the positioning rack 416 is protruded and extended towards the external frame 36 to form a plurality of snaps 4161 that are correspondingly engaged with the external frame 36 and the first earphone body 30; the key 4162 and the springy member 414 are correspondingly accommodated in the positioning member 411, and the positioning rack 416 and the positioning member 411 are fixed on the shell 37 via a plurality of fastening members 415; the shell 37 described above has a via hole 371 openly disposed thereon so as to expose the key 4162 from the via hole 371; the external frame 36 and the first earphone body 30 respectively have a plurality of first docking holes 366 and a plurality of second docking holes 309 formed thereon; the snaps 4161 are correspondingly engaged with the first and the second docking holes 366 and 309, such that the shell 37 is engaged on the first earphone body 30.

By using the designed structure of the embodiment, when the user desires to hear the external sounds, the user can press the key 4162 on the shell 37, and then the key 4162 drives the snaps 4161 engaged on the first earphone body 30 to be disengaged, so as to enable the shell 37 and the external frame 36 to be separated from the first earphone body 30; further, by having the gap 4064 of the sliding member 406 correspondingly engaged with the protrusion bar 4051 of the engagement member 405, the shell 37 and the external frame 36 are still partially connected to the first earphone body 30; that is, the connection unit 40 and the positioning unit 41 disposed on the ear cover sets 3 enable the shell 37 to be pulled open without becoming completely separated from the first earphone body 30. As a result, the external sounds can still be heard while listening to music without having to completely taking off the earphone, thereby achieving an open-close type earphone structure 1 having multiple applications, and significantly increasing the convenience in use.

Figure 9:
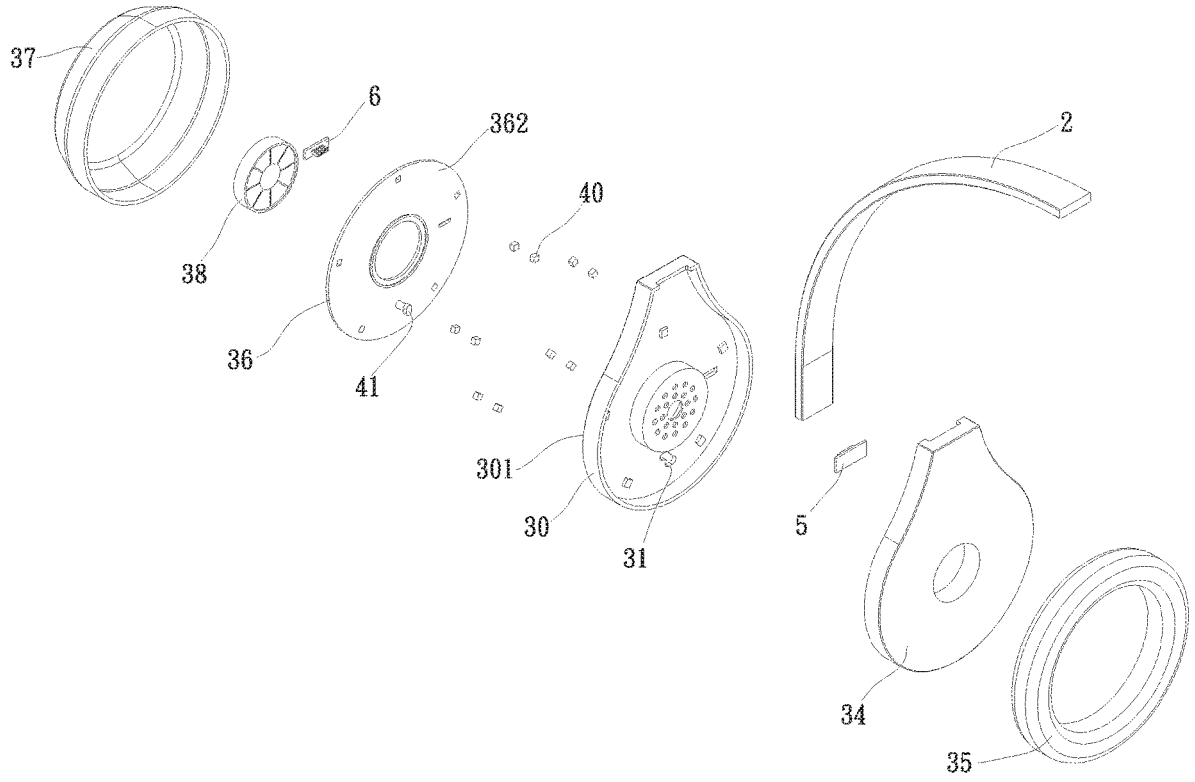
FIG. 9 is a stereoscopic disassembled view in accordance with a third embodiment of the open-close type earphone structure of the present invention.
Figure 10:
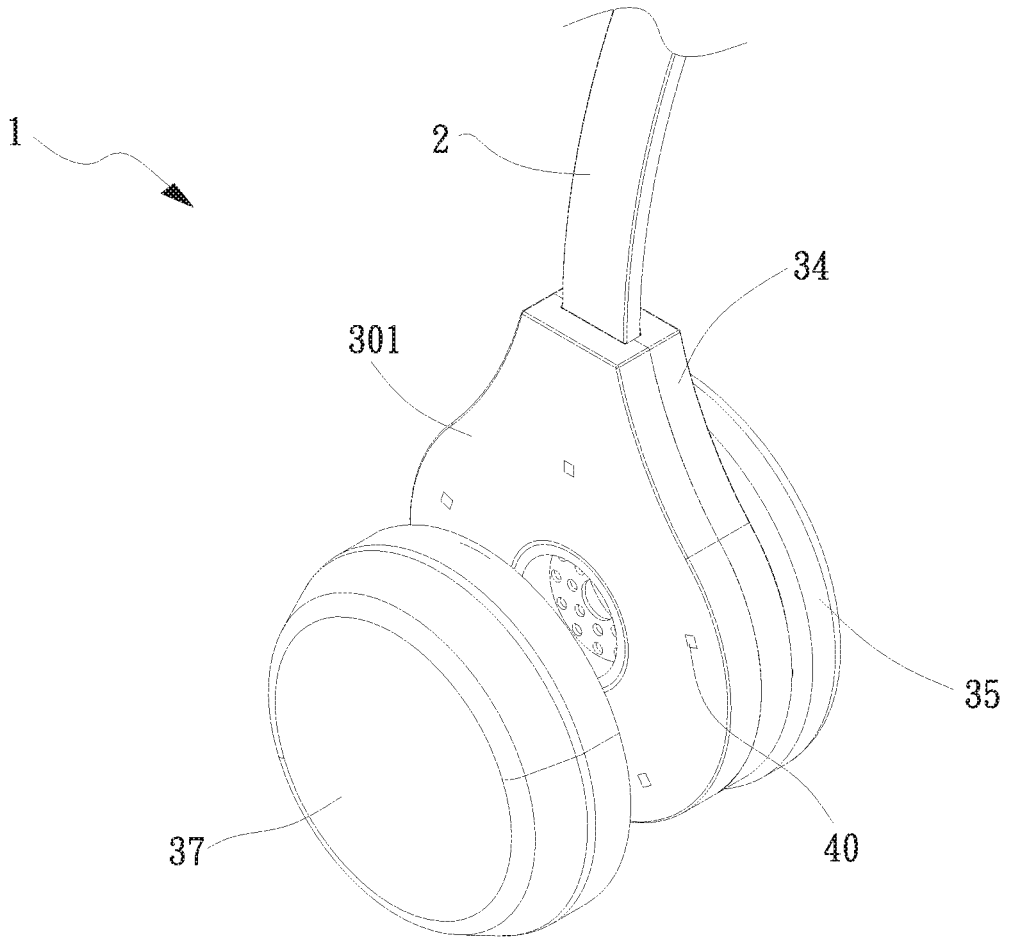
FIG. 10 is a stereoscopic assembled view in accordance with the third embodiment of the open-close type earphone structure of the present invention.

In addition to FIG. 1, referring to FIGS. 9 and 10, which are the stereoscopic disassembled view and the stereoscopic assembled view in accordance with a third embodiment of the open-close type earphone structure of the present invention. The corresponding relationship between a part of components of the open-close type earphone structure is identical to that of the open-close type earphone structure described above, and thus will not be repeated here. The main difference between the open-close type earphone structure and the one described above is that; the connection unit 40 is correspondingly and embeddingly provided on the second surface 362 of the external frame 36 and the first side 301 of the first earphone body 30 respectively, and the connection unit 40 is selected from a magnet or a magnetic component; the first earphone body 30 has at least one sliding groove 31 openly disposed thereon; the positioning unit 41 is disposed on the second surface 362 of the external frame 36 and correspondingly and slidingly engaged with the sliding groove 31, such that the positioning unit 41 is slidably provided in the sliding groove 31; mutual attachments between the connection units 40 provided on the second surface 362 and on the first side 301 enable the shell 37 to be opened and closed with respect to the first earphone body 30, and thus the structure of the embodiment can also achieve the effect described above.

In summary, the present invention has the following advantages in comparison to the prior art:

1. is capable of enabling external environmental sounds to be heard while listening to music;
2. has multiple applications;
3. and can significantly increase convenience in use.

Although the present invention has been thoroughly explained as above, it is to be understood that the embodiments described herein are merely the preferred embodiments of the present invention and cannot be used to limit the scope of implementation of the present invention, and any changes and modifications made according to the scope of the present invention that are equivalent in effect are comprised in the scope of the claims of the present application.

The invention claimed is:

1. An open-close type earphone structure, comprising:

a headwear rack;

a pair of ear cover sets respectively disposed on two opposite ends of the headwear rack, each of the ear cover sets comprising:

a first earphone body having a first side and a second side, the second side being correspondingly disposed to the headwear rack;

a second earphone body having a third side and a fourth side, the third side being correspondingly disposed to the headwear rack and opposingly connected to and assembled with the second side, the fourth side being provided with an ear cover;

an external frame having a first surface and a second surface, wherein the second surface is correspondingly provided on the first side; a shell correspondingly covering the first surface, the shell and the first surface collectively defining an accommodation space therebetween for disposing a speaker unit;

a positioning module correspondingly disposed to the ear cover sets, the positioning module having at least one connection unit and at least one positioning unit, so as to enable the shell and the external frame to be opened and closed with respect to the first earphone body via the connection unit and the positioning unit;

wherein the connection unit further comprises a fixing shaft, a pivotal member and a torsion spring, and the fixing shaft is correspondingly and penetratingly disposed through the pivotal member and the torsion spring;

wherein the pivotal member further has an engagement end and a pivotal end formed thereon, the engagement end is correspondingly engaged on the external frame, and the pivotal end has a pivot hole formed thereon for penetratingly disposing the fixing shaft.

2. The open-close type earphone structure of claim 1, wherein the first earphone body further has a fixing portion and an accommodation portion formed thereon, two ends of the fixing shaft are correspondingly inserted into the fixing portion, and the pivotal member is correspondingly accommodated in the accommodation portion.

3. The open-close type earphone structure of claim 1, wherein the positioning unit further comprises a positioning member, a button and a springy member, and the button and the springy member are correspondingly disposed in the positioning member.

4. The open-close type earphone structure of claim 3, wherein two sides of the positioning member are respectively protruded and extended to form a positioning portion, and at least one fastening member is correspondingly fastened on the positioning portion, so as to enable the positioning unit to be fixed on the shell.

5. The open-close type earphone structure of claim 3, wherein the button further has a press portion and a snap-on portion formed thereon, the shell has a via hole for exposing the press portion therefrom, and the first earphone body has an opening for enabling the snap-on portion to be snapped thereon.

6. The open-close type earphone structure of claim 3, wherein the external frame further has a first notch and a second notch openly disposed thereon, the positioning member is correspondingly and embeddingly disposed on the first notch, and a socket is further formed on the first surface of the external frame in correspondence with the second notch; the engagement end is correspondingly inserted into the socket.

7. An open-close type earphone structure, comprising:

a headwear rack;

a pair of ear cover sets respectively disposed on two opposite ends of the headwear rack, each of the ear cover sets comprising:

a first earphone body having a first side and a second side, the second side being correspondingly disposed to the headwear rack;

a second earphone body having a third side and a fourth side, the third side being correspondingly disposed to the headwear rack and opposingly connected to and assembled with the second side, the fourth side being provided with an ear cover;

an external frame having a first surface and a second surface, wherein the second surface is correspondingly provided on the first side; a shell correspondingly covering the first surface, the shell and the first surface collectively defining an accommodation space therebetween for disposing a speaker unit;

a positioning module correspondingly disposed to the ear cover sets, the positioning module having at least one connection unit and at least one positioning unit, so as to enable the shell and the external frame to be opened and closed with respect to the first earphone body via the connection unit and the positioning unit;

wherein the connection unit further comprises an engagement member and a sliding member, the engagement member is correspondingly disposed on an inner side of the shell, and the sliding member is correspondingly and penetratingly disposed through the first earphone body and engaged with the engagement member;

wherein the sliding member further has an abutting end and a sliding end formed thereon, an elastic member is provided at the abutting end for correspondingly abutting against a fixing plate, and a front end of the sliding end has at least one gap formed thereon to be correspondingly engaged with a protrusion bar of the engagement member.

8. The open-close type earphone structure of claim 7, wherein the first earphone body further has a through hole, at least one first locking hole and at least one second locking hole formed thereon, the sliding end is correspondingly and penetratingly disposed through the through hole; at least one first locking attachment is correspondingly and penetratingly disposed through the sliding member and fastened on the first locking hole, and at least one second locking attachment is correspondingly and penetratingly disposed through the fixing plate and fastened on the second locking hole.

9. The open-close type earphone structure of claim 8, wherein a position of the sliding member corresponding to the abutting end is protruded and extended downwards to form an extension portion, and the first locking attachment is correspondingly and penetratingly disposed through the extension portion.

10. The open-close type earphone structure of claim 7, wherein the positioning unit further comprises a positioning rack having a key protrudingly disposed thereon, the positioning rack is correspondingly disposed on an inner wall of the shell, and an outer peripheral edge of the positioning rack is protruded and extended towards the external frame to form a plurality of snaps to be correspondingly engaged with the external frame and the first earphone body.

11. The open-close type earphone structure of claim 10, wherein the positioning unit further comprises a positioning member and a springy member, and the key and the springy member are correspondingly accommodated in the positioning member.

12. The open-close type earphone structure of claim 11, wherein the positioning rack and the positioning member are fixed on the shell via a plurality of fastening members.

13. The open-close type earphone structure of claim 10, wherein the shell has a via hole for exposing the key therefrom, the external frame and the first earphone body respectively have a plurality of first docking holes and a plurality of second docking holes formed thereon, and the snaps are correspondingly engaged with the first and the second docking holes so as to enable the shell to be engaged on the first earphone body.

14. The open-close type earphone structure of claim 1, wherein the connection units are correspondingly and embeddingly disposed on the second surface and the first side respectively, and the connection units can be selected from a magnet or a magnetic component.

15. The open-close type earphone structure of claim 14, wherein the first earphone body has at least one sliding groove openly disposed thereon, and the positioning unit disposed on the second surface corresponds to and is slidingly engaged with the sliding groove, so as to enable the positioning unit to be slidably disposed in the sliding groove.

16. The open-close type earphone structure of claim 14, wherein the shell can be opened and closed with respect to the first earphone body via mutual attachments between the connection units disposed on the second surface and the first side.

17. The open-close type earphone structure of claim 1, wherein the connection unit further has an adjustment portion, and the adjustment portion enables an angle between the connection unit and the first earphone body to be adjusted in a stepwise manner when the connection unit is opened and closed with respect to the first earphone body.

* * * * *